US007356948B2

(12) United States Patent
Arzberger et al.

(10) Patent No.: US 7,356,948 B2
(45) Date of Patent: Apr. 15, 2008

(54) CUTTING WHEEL FOR A TRENCH WALL CUTTER

(75) Inventors: Maximilian Arzberger, Igenhausen (DE); Ignaz Anton Seitle, Karlshuld (DE); Ludwig Andreas Huber, Thalhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 281 days.

(21) Appl. No.: 11/216,025

(22) Filed: Sep. 1, 2005

(65) Prior Publication Data

US 2006/0070269 A1 Apr. 6, 2006

(30) Foreign Application Priority Data

Sep. 3, 2004 (EP) ..... 04020996

(51) Int. Cl.
*E02F 5/02* (2006.01)

(52) U.S. Cl. ..... 37/365; 37/189

(58) Field of Classification Search ..... 37/462, 37/463, 465, 189, 190, 452, 455, 364, 365; 299/39.8, 85.2

See application file for complete search history.

(56) References Cited

U.S. PATENT DOCUMENTS 1,092,632 A * 4/1914 Crain ..... 172/96
2,549,088 A * 4/1951 Hettelsater et al. ..... 37/189
3,280,486 A * 10/1966 Hackel ..... 37/452
3,589,452 A * 6/1971 Haker et al. ..... 172/548
4,197,662 A * 4/1980 McAulay et al. ..... 37/189
4,242,814 A * 1/1981 Fluks ..... 37/329
4,477,989 A * 10/1984 Vachon ..... 37/252
4,694,915 A 9/1987 Bauer et al.
7,158,273 B2 * 1/2007 Stadler et al. ..... 359/3
7,178,273 B2 * 2/2007 Arzberger ..... 37/189
2004/0234345 A1 11/2004 Arzberger

FOREIGN PATENT DOCUMENTS

| | | |
|---|---|---|
| CA | 1128558 | 7/1982 |
| CA | 2 457 229 | 8/2004 |
| DE | 34 24 999 A1 | 1/1986 |
| DE | 199 41 801 A1 | 9/2001 |
| DE | 103 08 538 A1 | 9/2004 |
| GB | 2065195 A | 6/1981 |
| JP | 7-54334 | 2/1995 |
| JP | 11-200404 | 7/1999 |

* cited by examiner

*Primary Examiner*—Gary S. Hartmann
(74) *Attorney, Agent, or Firm*—Jacobson Holman PLLC

(57) ABSTRACT

The invention relates to a cutting wheel for trench wall cutter, having a cutting wheel hub and at least one cutting tooth holder, which is located in substantially radially projecting manner on the cutting wheel hub. The cutting wheel according to the invention is characterized in that there is at least one mixing blade on the outside of the cutting wheel hub.

10 Claims, 3 Drawing Sheets

CUTTING WHEEL FOR A TRENCH WALL CUTTER

BACKGROUND OF THE INVENTION

1. Field of the Invention

The invention relates to a cutting wheel having a cutting wheel hub and at least one cutting tooth holder, which is located in substantially radially projecting manner on an outside of the cutting wheel hub.

2. Related Art

DE 34 24 999 C2 discloses a trench wall cutter for producing a trench wall. This known trench wall cutter has a cutting frame and cutting wheels drivable in rotary manner fixed to the underside thereof. Cutting teeth for working off soil material are circumferentially provided on the cutting wheels.

German patent application 103 08 538 discloses a method for producing a trench wall. In this known method, the suspension hardening to the trench wall is produced directly within said trench. To this end soil material removed by the cutting wheels of a trench wall cutter are mixed in the cut trench by the action of the cutting wheels so-to-speak in situ with a binder, particularly a settable liquid and as a result a hardening binder-soil mixture is produced. In this method the removed soil material mixed with the binder is at least partly left in the cut trench, where it can harden for forming the trench wall. This obviates the need for pumping means to in complicated manner convey above ground all the removed soil material.

SUMMARY OF THE INVENTION

The object of the invention is to provide a cutting wheel for a trench wall cutter permitting the production of particularly high quality trench walls.

According to the invention this object is achieved by a cutting wheel for a trench wall cutter having a cutting wheel hub and at least one cutting tooth holder, which is arranged in substantially radially projecting manner on an outside of the cutting wheel hub, wherein at least one mixing blade is provided on the outside of the cutting wheel hub.

A cutting wheel according to the invention is characterized in that at least one mixing blade is provided on the outside of the cutting wheel hub.

A fundamental idea of the invention is to provide on the cutting wheel a mixing blade for thoroughly mixing the suspension in the trench produced. In the same way as the cutting tooth holder the mixing blade is located on the outside of the cutting wheel hub, which can also be referred to as the peripheral and/or circumferential side of the cutting wheel hub. On rotating the cutting wheel hub during cutting operation both the cutting tooth holder and the mixing blade are rotated. This rotary operation of the mixing blade ensures a better mixing and therefore homogeneity of the suspension and consequently leads to an improved trench wall quality.

The cutting wheel according to the invention is particularly suitable for in situ suspension production, in which the suspension hardening to the trench wall is produced in the cut trench by mixing worked off soil material with a binder. Since, according to the invention, the mixing blade is located on the cutting wheel, i.e. in the area in which the outcropping soil material is directly worked off, the invention permits a particularly effective thorough mixing of the freshly worked off soil material, so that the trench wall quality is further improved.

It is fundamentally possible for the mixing blade to be spaced from the cutting tooth holder. However, a cutting wheel particularly simple from the design standpoint is obtained by constructing the mixing blade on a cutting tooth holder. According to the invention several mixing blades and/or cutting tooth holders can be provided and preferably each mixing blade is located on a different cutting tooth holder. In particularly preferred manner there are four cutting tooth holders, a mixing blade being provided on each of at least three thereof. As a function of the axial width of the cutting wheel hub, there can obviously be more than four cutting tooth holders which are distributed over the hub circumference. Advantageously at least one cutting tooth holder is positioned pivotably on the cutting wheel hub. As a result of such a pivotable cutting tooth holder a hinge tooth can be formed which is axially adjustable and which can in particular serve for working off soil material below a cutting plate for maintaining the cutting wheel alongside the cutting wheel hub. In conjunction with the invention the axial and radial directions can in particular relate to the rotation axis of the cutting wheel hub.

Fundamentally the mixing blade can be located at a random position on the cutting tooth holder. Thus, the cutting blade can e.g. be fitted centrally to a flat side of the cutting tooth holder facing the axial direction. According to the invention a particularly good mixing action is brought about in that the mixing blade is positioned on a longitudinal side of the cutting tooth holder, particularly on an incident flow side of said holder against which there is a flow during rotary cutting operation. The term longitudinal side can in particular be an end side of the cutting tooth holder running along the latter from the cutting wheel hub to the cutting wheel circumference. The cutting tooth holder is appropriately made from sheet metal. By positioning the mixing blade on the incident flow side it is possible to create in the vicinity of the flat sides of the cutting tooth holder a dead water or wake area where there can be a particularly effective suspension mixing.

For a particularly good mixing action it is also possible for the mixing blade to project axially on the cutting tooth holder, preferably on either side of the latter. According to this embodiment the cutting tooth holder is constructed in the vicinity of the mixing blade, i.e. with an axial wall thickness increase. The mixing blade can e.g. be constructed as a web running along one of the two flat sides of the cutting tooth holder. Preferably such webs are provided on both facing flat sides. A mixing blade projecting axially from the cutting tooth holder can also be obtained in that said cutting tooth holder is e.g. bent at right angles and/or compressed towards the wall thickness increase.

A particularly simple cutting wheel from the design standpoint can be obtained by the mixing blade having a plate which is in particular at least roughly perpendicular to the cutting tooth holder. For example, the plate can be so positioned on a longitudinal side of the cutting tooth holder, particularly on the incident flow side, that said holder together with the plate has an at least approximately T-shaped cross-section. Besides a right-angled arrangement of the plate on the cutting tooth holder, arrangements at different angles are also possible.

The mixing action can be further improved in that the mixing blade is directed at least approximately tangentially to the cutting wheel hub circumference. With such an arrangement it is possible to press the material to be mixed using the mixing blade against the outcropping soil, so that there is a forced mixing between the mixing blade and the soil.

In order to bring about a particularly high cutting advance, it can be advantageous to provide a cutting tooth, more particularly terminally, on the cutting tooth holder. The term terminal arrangement can in particular be an arrangement in the vicinity of the cutting wheel circumference. A particularly simple design is brought about in that the cutting tooth is located at least approximately at right angles to a longitudinal side of the mixing blade, particularly to the incident flow side of the cutting tooth holder. Advantageously the cutting tooth is roughly at right angles to the mixing blade.

The cutting advance of the inventive cutting wheel can be improved in that a cutting edge of the cutting tooth is set back with respect to the mixing blade, relative to the circumferential direction of the cutting wheel. According to this embodiment the mixing blade is in advance of the cutting edge i.e. in the rotation operating direction of the cutting wheel.

A further preferred embodiment of the invention involves the cutting tooth being spaced from the mixing blade, accompanied by the formation of a mixing blade-free space. Thus, during the rotary operation of the cutting wheel, the surrounding suspension can particularly effectively flow against the cutting tooth and is washed free so as to ensure a good cutting advance.

In order to obtain a cutting wheel with a particularly low moment of inertia whilst still having a good mixing action, the incident flow side of the cutting tooth holder can be set back in the vicinity of the free space accompanied by the formation of a recess which is in particular circular segmental in section. According to this embodiment the cutting tooth holder width in an intermediate area between the mixing blade and the cutting tooth is reduced and consequently there is a taper on the surface of the flat sides of the cutting tooth holder. Advantageously the incident flow side is circular segmental in the vicinity of the recess.

To obtain a particularly large cutting cross-section, it is advantageous to provide at least one further cutting tooth holder in pivotable manner on the cutting wheel hub. As a result the cutting tooth holder is in particular axially adjustable. A pivoting axis for the cutting tooth holder is appropriately perpendicular to the rotation axis of the cutting wheel and especially roughly tangential to the cutting wheel hub circumference. The further cutting tooth holder can be constructed with or without mixing blades.

Another aspect of the invention is a trench wall cutter with a frame, at least one cutting wheel mounted in rotary manner on the frame and a drive for the rotary driving of the at least one cutting wheel, which is constructed in the manner described hereinbefore and hereinafter.

The invention is described in greater detail hereinafter relative to preferred embodiments shown in the drawings. The drawings schematically show:

DETAILED DESCRIPTION OF THE PREFERRED EMBODIMENTS

Figure 1:
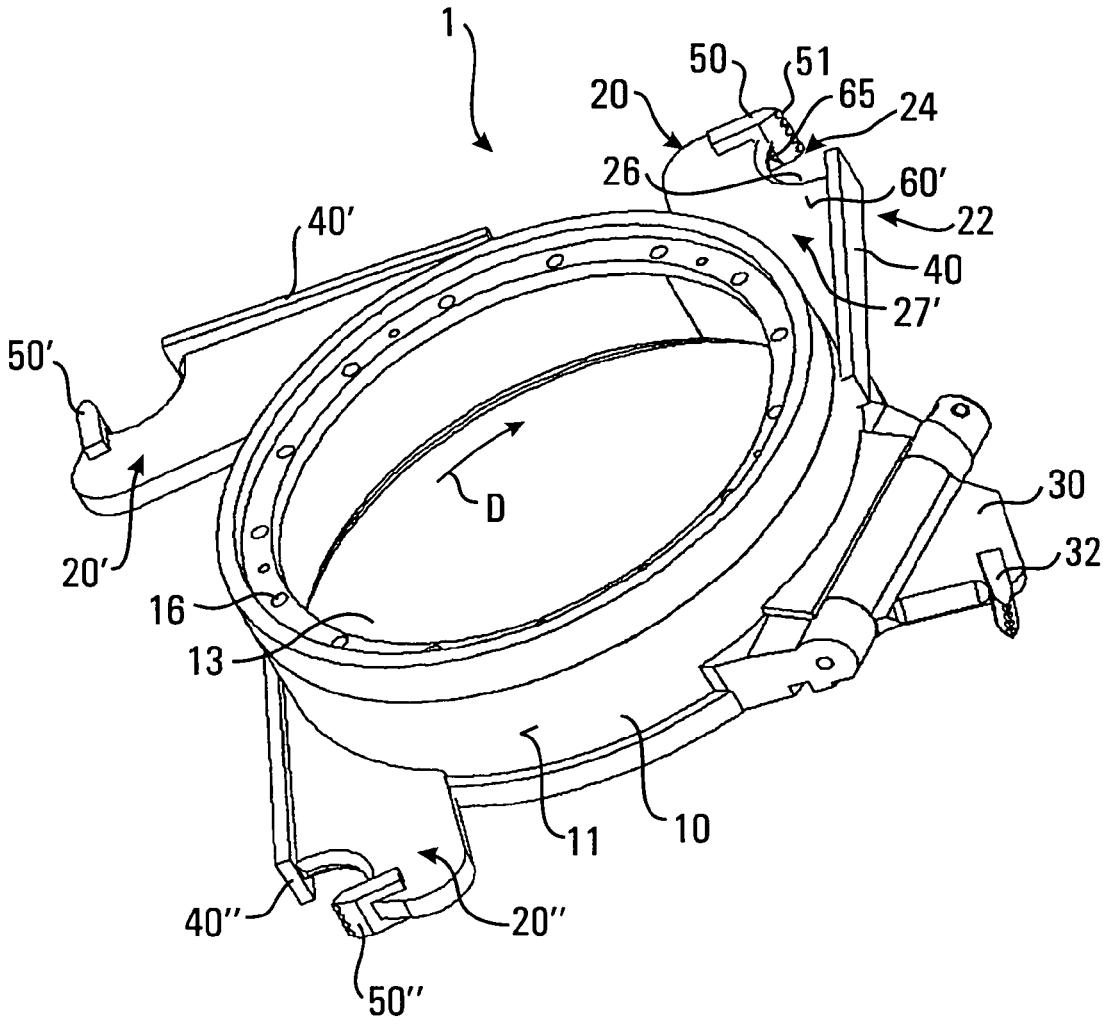
FIG. 1 A perspective view of a cutting wheel according to the invention.

Identically acting elements are given the same reference numerals in all the drawings.

Figure 2:
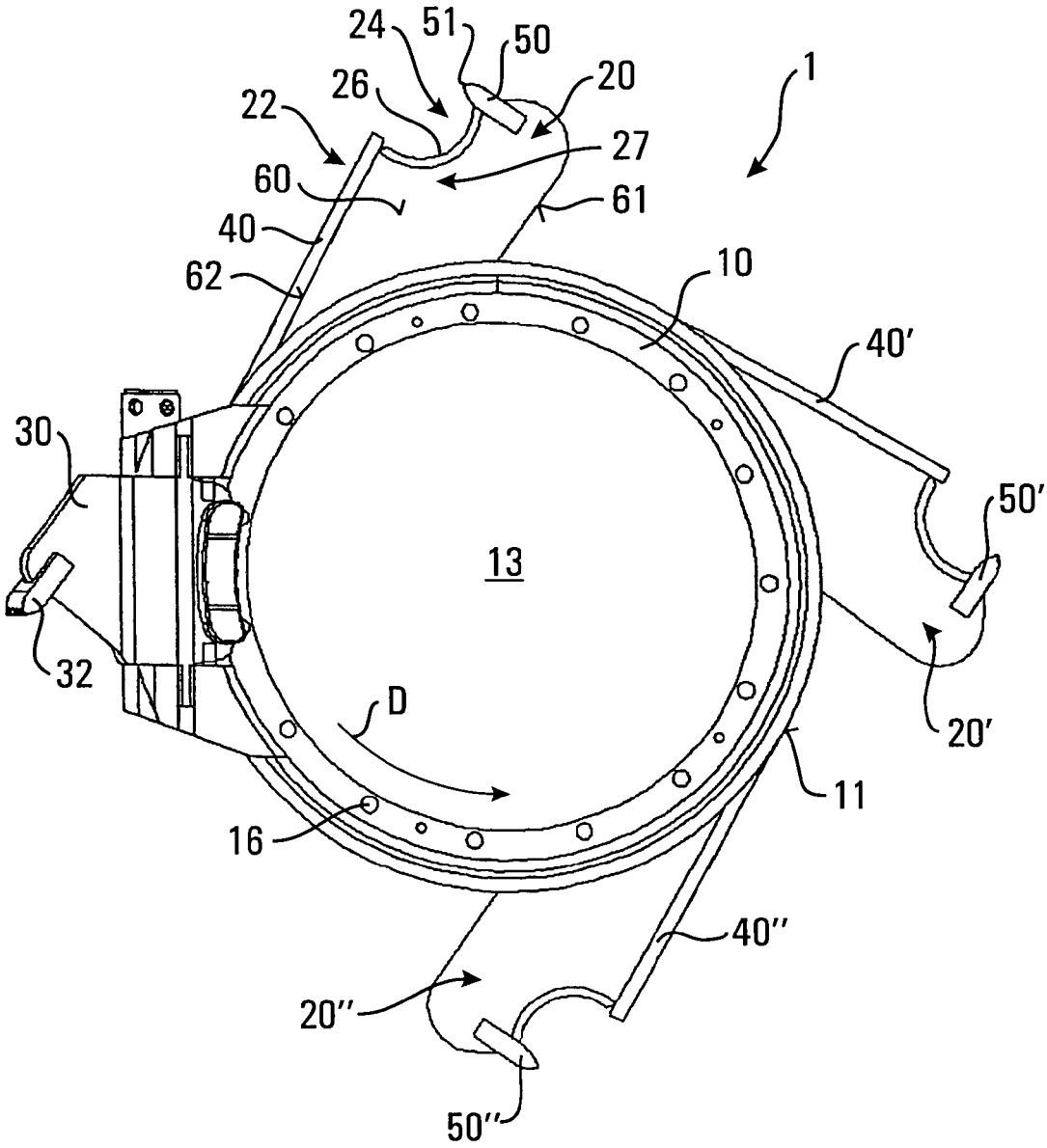
FIG. 2 A front view of the cutting wheel of FIG. 1.

A first embodiment of an inventive cutting wheel 1 is shown in FIGS. 1 and 2. The cutting wheel 1 is centrally provided with a cutting wheel hub 10. The cutting wheel hub 10 has a sleeve-like construction, i.e. is cylinder jacket-like and is centrally provided with a through opening 13 for receiving a drive shaft 14, 14' visible in FIG. 3. On the cutting wheel hub are provided circumferentially axially directed holding bores 16 with which the cutting wheel hub 10 can be secured on the driving shaft 14, 14'. On the outside 11 of the cutting wheel hub 10 forming the circumferential surface there are in all three fixed cutting tooth holders 20, 20', 20" constructed as sheet metal holders, which project roughly radially from the cutting wheel hub 10.

As is shown in exemplified manner on cutting tool holder 20 for all the cutting tooth holders 20, 20', 20", the flat sides 60, 60' of the cutting tooth holder 20 face the axial direction, i.e. they are at least approximately perpendicular to the axial direction. As is also shown using the example of cutting tooth holder 20, the two longitudinal sides 61, 62 of the cutting tooth holder 20 are at an acute angle to the outside 11 of the cutting wheel hub 10. As a result the cutting tooth holder 20 does not project precisely radially from the cutting wheel hub 10 and is instead directed rearwards counter to the operating rotation direction D.

On the longitudinal side 62 of the cutting tooth holder 20 leading in the operation rotation direction D, i.e. on its incident flow side 22, is provided a mixing blade 40. Said mixing blade 40 is constructed in the form of a planar plate which, accompanied by the formation of a T-profile, is welded in right-angled manner to the cutting tooth holder 20. Starting from the outside 11 of the cutting wheel hub 10, the mixing blade 40 runs tangentially to said outside 11 along the leading longitudinal side 62 of the cutting tooth holder 20 in the outwards direction. As a result of the mixing blade 40 on the incident flow side of the cutting tooth holder 20 is formed an area where the wall thickness of the cutting tooth holder 20 is increased in steplike manner with respect to a rear area 27, 27' of said holder 20 located on the flat sides 60, 60'. This change to the wall thickness in the incident flow direction can lead to turbulence during the rotation of the cutting wheel 1 and which more particularly in the rear area 27, 27', which can also be called the wake area, can lead to a particularly good mixing of the suspension.

Externally, i.e. in an area close to the cutting wheel circumference, a cutting tooth 50 is provided on cutting tooth holder 20. The cutting tooth 50 has a tapering cutting edge 51 for working off outcropping soil material. The cutting tooth 50 has an at least approximately mirror symmetrical construction, the cutting edge 51 being located on the corresponding plane of symmetry. The cutting tooth 50 is positioned in such a way that its plane of symmetry and/or its longitudinal axis is at least approximately perpendicular to the mixing blade 40 and/or the front longitudinal side 62 of the cutting tooth holder 20.

The cutting tooth 50, like the mixing blade 40, is provided on the incident flow side 22 of the cutting tooth holder 20. However, the mixing blade 40 does not extend up to the cutting tooth 50. In fact the cutting tooth 50 is spaced from the mixing blade 40. In an intermediate area between the cutting tooth 50 and the mixing blade 40 this leads to the formation of a free space 24 where on the incident flow side there is no mixing blade 40 and which can therefore be referred to as a mixing blade-free space 24. In the vicinity of said free space 24 the cutting tooth holder 20 is constructed with a taper in which the circumferentially measured width of the cutting tooth holder 20 decreases from the mixing blade 40 to the cutting tooth 50. For forming this taper the incident flow side 22 of the cutting tooth holder 20, starting from the mixing blade 40, runs in the form of a circular segment to the cutting tooth 50. As a result of the taper, in the area between the cutting tooth 50 and mixing blade 40 a circular segmental recess is formed on the flat sides 60, 60'. For aiding the cutting action, in the vicinity of the free space 24 and accompanied by the formation of an edge 65, the incident flow side 22 of the cutting tooth holder 20 can have a tapered construction.

The remaining cutting tooth holders 20', 20" are constructed substantially identically to the cutting tooth holder 20 and also have mixing blades 40', 40" and cutting teeth 50', 50". The individual cutting tooth holders 20, 20', 20" are located on the outside 11 of the cutting wheel hub 10 with an angular displacement of in each case approximately 90ø. As can in particular be gathered from FIG. 1, the individual cutting tooth holders 20, 20', 20" are also located with an axial displacement on the outside 11 of the cutting wheel hub 10.

Besides the fixing cutting tooth holders 20, 20', 20" there is a further cutting tooth holder 30 pivotably articulated to the outside 11 of the cutting wheel hub 10. The pivoting axis is perpendicular to the rotation axis of the cutting wheel 1, so that the cutting tooth holder is adjustable by pivoting in the axial direction. On the further cutting tooth holder 30 is provided a further cutting tooth 32 constructed in the same way as cutting teeth 50, 50', 50".

Figure 3:
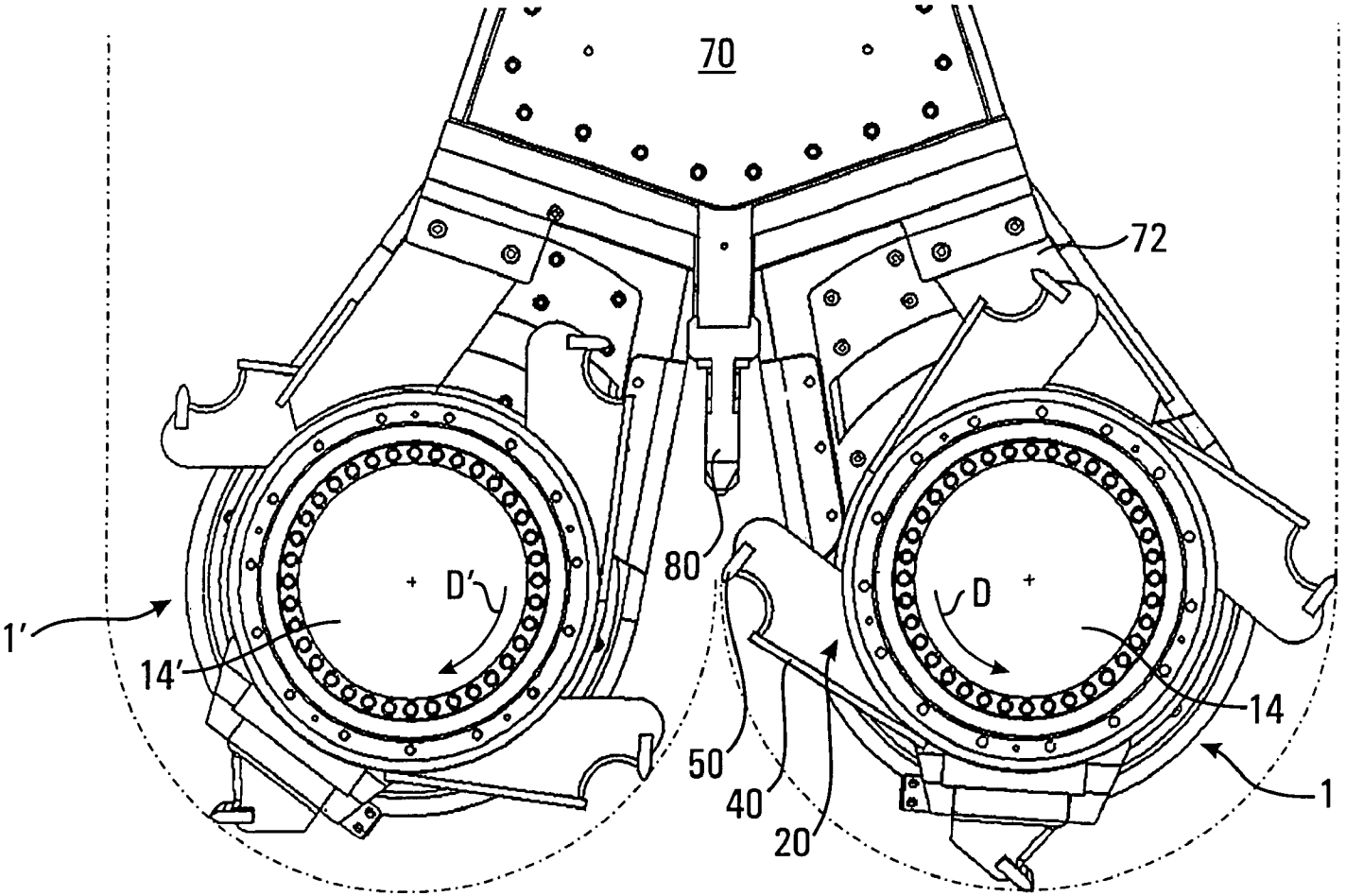
FIG. 3 A front view of the lower area of a trench wall cutter on which there are two cutting wheels according to FIGS. 1 and 2.

The lower part of an inventive trench wall cutter is shown in FIG. 3. The trench wall cutter has a frame 70 on whose bottom are provided two cutting wheels 1, 1'. The cutting wheels 1, 1' are mirror symmetrical and constructed in the manner described relative to FIGS. 1 and 2. A liquid supply device 80 for supplying a hardenable liquid into the trench is provided on frame 70 centrally between the two cutting wheels 1, 1'.

During cutting operation the two cutting wheels 1, 1' are operated with opposing operating rotation directions D, D'. The mixing blades 40 arranged at the front on the cutting tooth holders 20 in the rotation direction and which are constructed as plates or ledges downwardly feed the liquid passing out of the liquid supply device 80 and said liquid is mixed in there with the soil removed by the cutting teeth 50. The mixing blades 40 can press the liquid and/or mixture against the outcropping soil, so that there can be effected a forced mixing between mixing blades 40 and the soil.

Externally on the trench wall cutter, the cutting tooth holders 20 with their mixing blades 40 during operation in the operating rotation direction D, D' convey the worked off soil material upwards and away from the cutting wheel hub 10. While doing so, behind the mixing blades 40 a relief action can occur with further mixing of the suspension. By means of the cutting teeth 50, which are in particular constructed in leading manner, further soil material is released and mixed with the suspension.

On the frame 70 are provided clearing plates 72, which project between the axially adjacent cutting teeth 50, 50', 50" of the axially adjacent cutting tooth holders 20, 20', 20" and ensure a forced mixing and/or a stripping off of material adhering to the cutting teeth 50, 50', 50".

The invention claimed is:

1. A cutting wheel for a trench wall cutter, comprising:

a cutting wheel hub having a circumferential side and an axis, at least one cutting tooth holder projecting outwardly from the circumferential side of the cutting wheel hub, the cutting tooth holder having opposed first and second sides approximately perpendicular to the axis and opposed third and fourth longitudinal sides at an angle to the circumferential side of the cutting wheel hub, and the cutting tooth holder having means for holding a cutting tooth, and at least one mixing blade provided on a corresponding cutting tooth holder, wherein the mixing blade projects outwardly of both the first and second sides of the cutting tooth holder in a direction parallel to the axis.

2. The cutting wheel according to claim 1, wherein the cutting tooth holder has an incident flow side against which there is a flow during the rotary cutting operation, and a longitudinal side on the incident flow side, and wherein the mixing blade is located on the longitudinal side of the cutting tooth holder.

3. The cutting wheel according to claim 1, wherein the mixing blade comprises a plate, which is approximately perpendicular to the first and second sides of the cutting tooth holder.

4. The cutting wheel according to claim 1, wherein the mixing blade is directed approximately tangentially to the circumferential side of the cutting wheel hub.

5. The cutting wheel according to claim 1, further comprising a cutting tooth terminally provided on the cutting tooth holder and provided approximately at right angles to a longitudinal side of the mixing blade.

6. The cutting wheel according to claim 5, wherein the cutting tooth has a cutting edge set back with respect to the mixing blade, relative to the circumferential direction of the cutting wheel.

7. The cutting wheel according claim 2, further comprising a cutting tooth terminally provided on the cutting tooth holder, wherein the cutting tooth is spaced from the mixing blade to define a mixing blade-free space.

8. The cutting wheel according to claim 7, wherein the incident flow side of the cutting tooth holder is set back in the vicinity of the free space, accompanied by a recess which is circular segmental in section.

9. The cutting wheel according to claim 1, further comprising at least one further cutting tooth holder pivotably provided on the cutting wheel hub.

10. A trench wall cutter comprising:

a frame, at least one cutting wheel according to claim 1, wherein the at least one cutting wheel is mounted in rotary manner on the frame, and a drive for the rotary driving of the at least one cutting wheel.

* * * * *